US005499033A

United States Patent [19]

Smith

[11] Patent Number: 5,499,033

[45] Date of Patent: Mar. 12, 1996

[54] POLARISATION DIVERSITY ANTENNA

[75] Inventor: Martin S. Smith, Chelmsford, United Kingdom

[73] Assignee: Northern Telecom Limited, Montreal, Canada

[21] Appl. No.: 264,629

[22] Filed: Jun. 23, 1994

[30] Foreign Application Priority Data

Jul. 2, 1993 [GB] United Kingdom ..... 9313676

[51] Int. Cl.[6] ..... H01Q 1/30; H01Q 13/10

[52] U.S. Cl. ..... 343/700 MS; 343/770; 343/859; 343/768

[58] Field of Search ..... 343/700 MS, 767, 343/768, 770, 778, 771, 850, 820, 821, 822, 858, 859, 860, 865; H01Q 1/38, 13/10

[56] References Cited

U.S. PATENT DOCUMENTS 3,165,743 1/1965 Hatkin ..... 343/767

4,198,646 4/1980 Bowman ..... 343/768

FOREIGN PATENT DOCUMENTS 58-59604 4/1983 Japan ..... 343/700 MS

*Primary Examiner*—Donald T. Hajec
*Assistant Examiner*—Hoanganh Le
*Attorney, Agent, or Firm*—Lee, Mann, Smith, McWilliams, Sweeney & Ohlson

[57] ABSTRACT

A dual polarized flat plate antenna wherein a deliberate unbalance of phase and/or amplitude is introduced into a feed arrangement for one of the polarizations such that interactive coupling between colocated elements associated with the respective polarizations causes the beamwidth and/or shape of the radiation pattern for the other polarization to be controlled.

6 Claims, 3 Drawing Sheets

POLARISATION DIVERSITY ANTENNA

BACKGROUND OF THE INVENTION

This invention relates to a polarisation diversity antenna constructed as a flat plate antenna.

DESCRIPTION OF RELATED ART

A well known form of flat plate antenna comprises a pair of closely spaced correspondingly apertured ground planes with an interposed printed circuit film providing probes extending into the areas of the apertures and a feed network for the probes. This antenna construction lends itself to a cheap yet effective construction for an array antenna comprising either a linear array or a planar array of apertures.

A flat plate linear array antenna for a cellular telephone base station is disclosed in our co-pending patent application GB-A2279813.

The principle of diversity in antennas is also well known to combat losses in different conditions. Space diversity consists of utilising two spaced apart substantially identical antennas. Polarisation diversity consists of using two antennas with respective orthogonal polarisations to receive or transmit the same signals. Polarisation diversity holds promise for improvements when co-located antennas are used. This does not necessarily mean that the cross-polarised antennas have to have co-incident phase centres; the option is available to move the antennas closer together than necessary for co-polarised spatial diversity. The ability to do this means that a compact dual diversity arrangement (spatial and polarisation) may be effected, an option not workable with spatial diversity alone.

In the cellular base station context diversity is employed to combat a propagation environment subject to deep multipath fading. Base stations commonly employ sectored beam antennas for omnidirectional coverage in azimuth. Conventionally sectored base station antennas may comprise separate arrays for transmit and receive. Cellular radio systems rely on antenna radiation properties with sharp cut-off outside a beamwidth specific to the cellular layout.

The conventional dual polarised flat plate antenna comprises substantially identical radiating elements except for their orthogonal orientation. In the design of such antennas for cellular base stations the factors of beamwidth and beamshaping are of paramount importance.

SUMMARY OF THE INVENTION

According to the present invention there is provided a dual polarised flat plate antenna wherein a deliberate unbalance of phase and/or amplitude is introduced into the feed arrangement for one of the polarisations such that interactive coupling between colocated elements associated with the respective polarisations causes the beamwidth and/or shape of the radiation pattern for the other polarisation to be controlled.

According to one embodiment of the invention a dual polarised flat plate antenna arrangement comprising a pair of apertures each aperture having a first pair of colinear probes extending into the aperture, the first pair of probes having a first orientation parallel to an axis about which the apertures are disposed, a second pair of colinear probes extending into the aperture, the second pair of probes having a second orientation orthogonal to that of the first pair, first feed network means arranged to feed signals to the first pairs of probes and a second feed network means arranged to feed signals to the second pairs of probes, wherein in each element the respective probes for each orientation are fed as two pairs and each pair is fed in a balanced antiphase manner, characterised in that for the two pairs in at least one orientation the respective feed network means is arranged to introduce an unbalance between the balanced pairs.

The unbalance introduced by a feed network may be a power and/or a phase unbalance.

The effect of deliberately unbalancing the signals applied to one or both pairs of probes in a pair of orthogonally polarised radiating elements is to control the beamwidth and/or beam shape of the antenna beam pattern.

BRIEF DESCRIPTION OF THE DRAWINGS

Embodiments of the invention will now be described with respect to the accompanying drawings in which.

DESCRIPTION OF THE PREFERRED EMBODIMENTS

Figure 1:
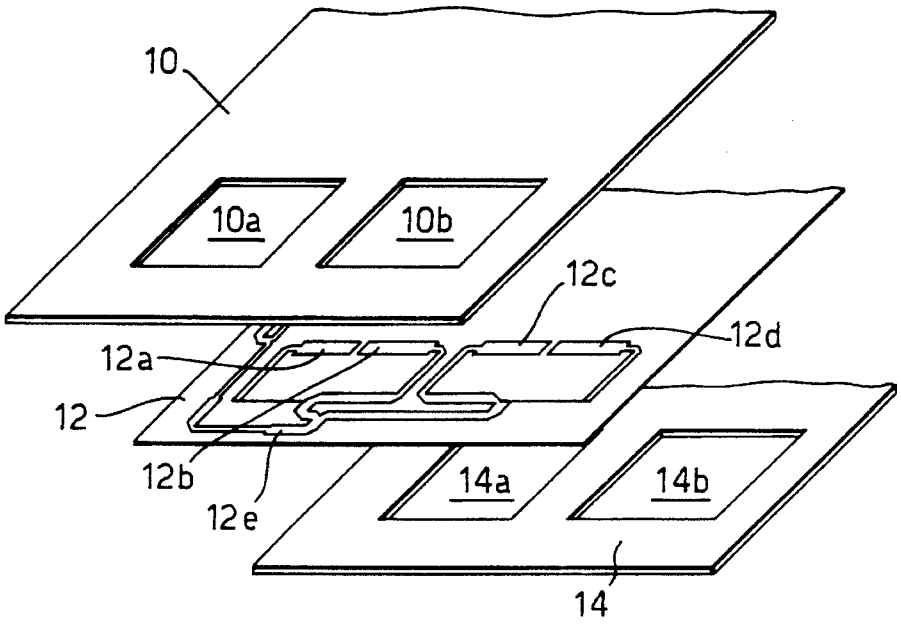
FIG. 1 is a perspective view of part of a linear array of single polarised radiating elements.
Figure 2:
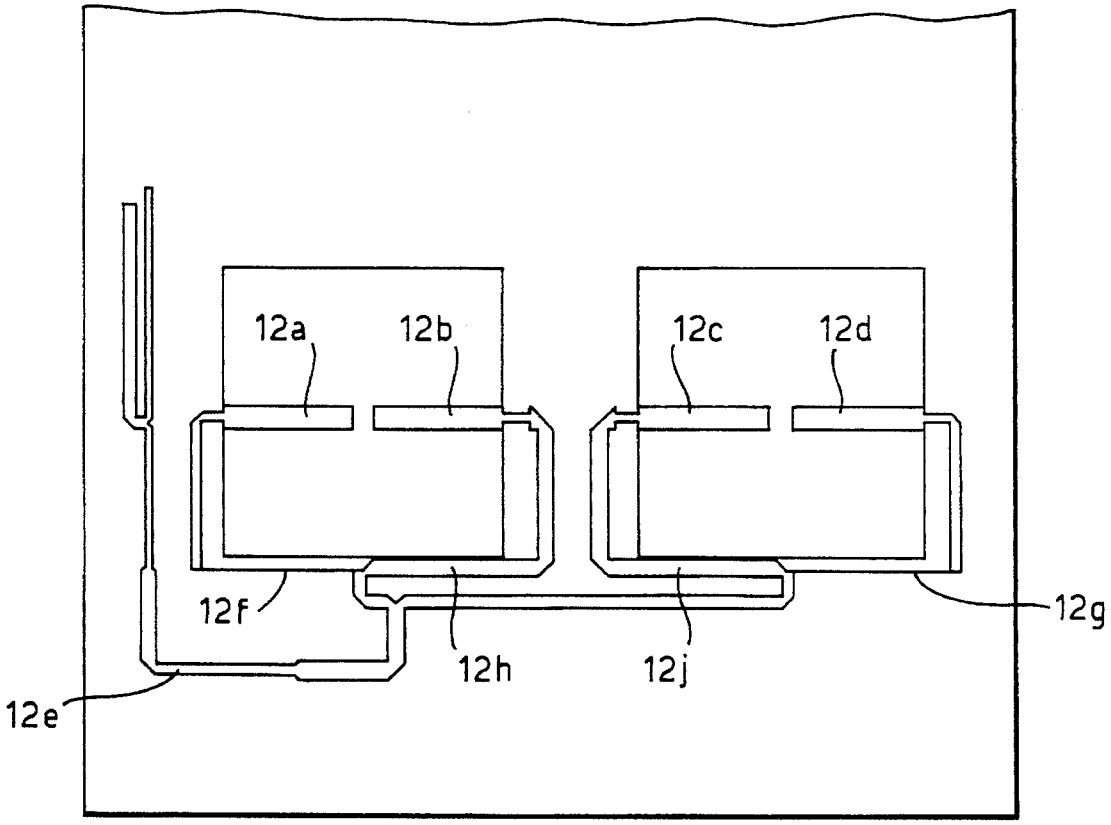
FIG. 2 is a plan view of the part array of FIG. 1.

Referring to the drawings a linear dual polarised antenna array comprises separate horizontal and vertical flat plate antenna structures one superimposed on the other. The horizontally polarised array shown in FIGS. 1 and 2 comprises a first aperture plate 10, a polyester film 12 carrying a printed circuit and a second aperture plate 14. The aperture plates 10 and 14 are substantially identical flat metal plates with pairs of corresponding apertures 10*a*, 10*b* and 14*a*, 14*b* which can be simply stamped out. The apertures shown are rectangular but may be a different shape, e.g. circular. The film 12 carried a printed metallic conductor pattern comprising pairs of probes 12*b*, 12*c* and 12*a*, 12*d* connected electrically by a feed network 12*e*. When the aperture plates and the film are placed together in a sandwich like structure the probes 12*a*–12*d* project into the areas of the apertures to form radiating elements, as shown in FIG. 2. The feed network 12*e* shown in FIG. 2 is constructed with equal length paths but with unbalanced impedances as instanced by the different conductor track widths at different parts of the network. Thus, again referring to FIG. 2, probes 12*a* and 12*d* are fed via high impedance sections 12*f*, 12*g* whereas probes 12*b* and 12*c* are fed via comparatively low impedance sections 12*h*, 12*j*. The net result is that the pairs of probes 12*b*, 12*c* and 12*a*, 12*d* respectively are unbalanced in that they receive different levels of power of the same signal.

Figure 3:
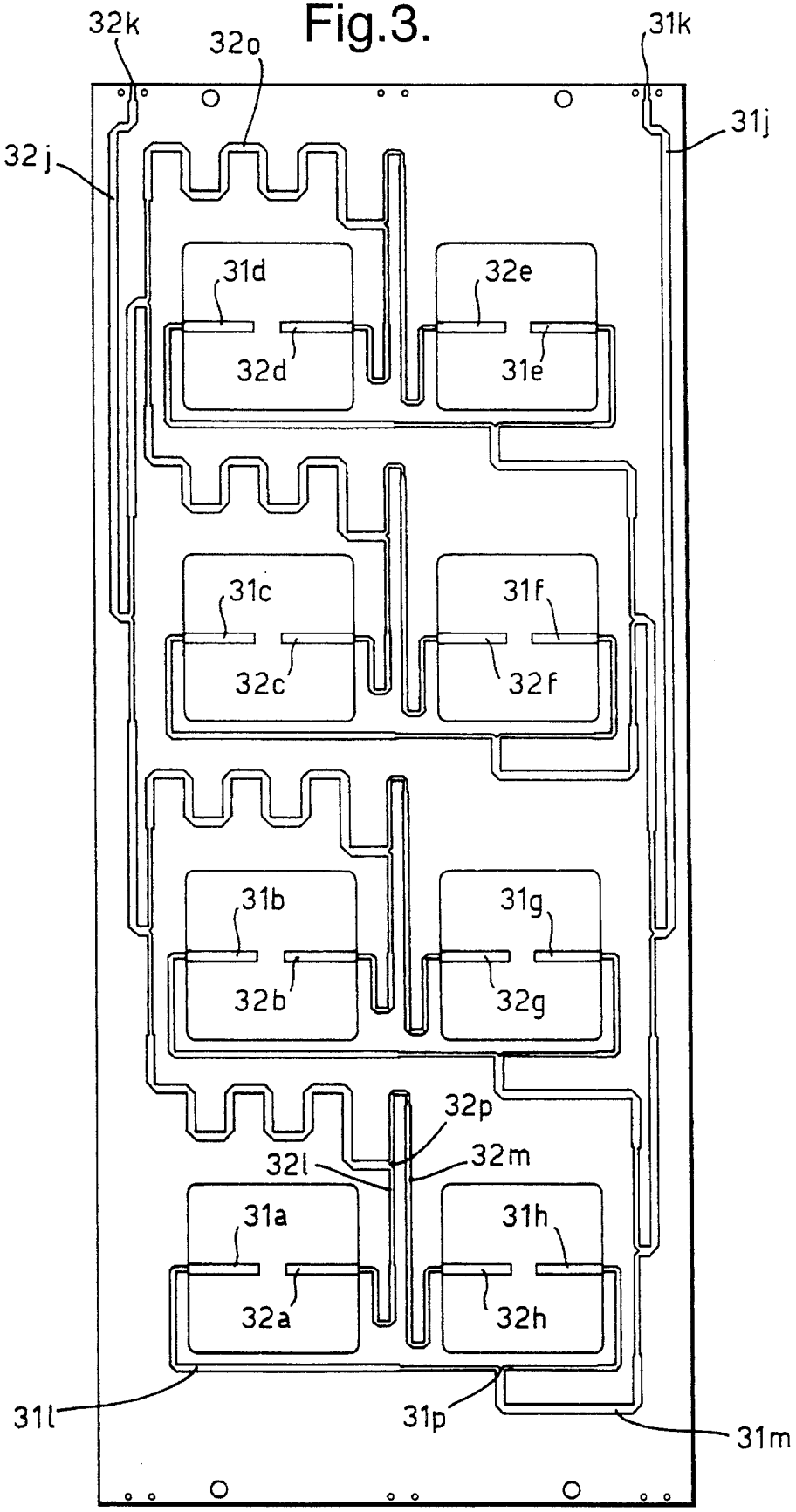
FIGS. 3 and 4 are plan views of respective horizontally and vertically polarised linear arrays to be combined to form a dual polarised linear array.
Figure 4:
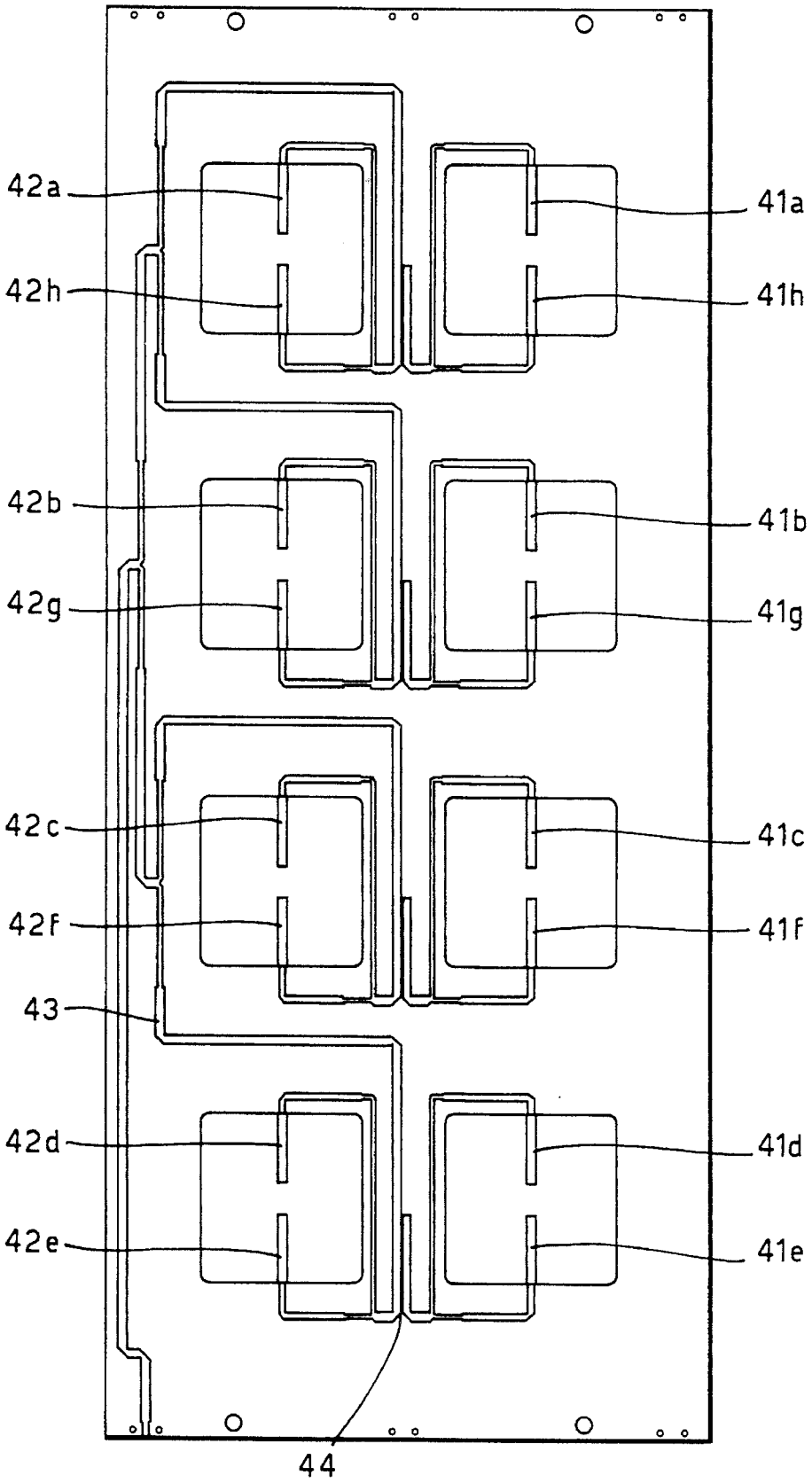

FIG. 3 shows in plan view a linear array of 4 pairs of horizontally polarised radiating elements similarly constructed as a flat plate antenna. In this embodiment the probes 31*a*–31*d* are fed in phase and probes 31*e*–31*h* in antiphase with equal power via a first feed network 31*j*. Likewise the probes 32*a*–32*d* are fed in phase and probes 32*e*–32*h* are fed in antiphase, again with equal power via a second feed network 32*j*. However, inspection of the feed network patterns 31*j* and 32*j* shows that, assuming both networks are fed with the same input signal at ports 31*k* and 32*k*, the phase between the probes of each pair is altered by the lengths of the respective feed networks 31*j* and 32*j* from each common point being different. FIG. 4 shows similarly in plan view a linear array of 4 pairs of vertically polarised radiating elements also constructed as a flat plate antenna. In this case the probes 41*a*–41*d* are fed in phase and probes 41*e*–41*h* are fed in antiphase via couplers 44 from feed network 43. Probes 42*a*–42*d* are fed in phase and probes 42*e*–42*h* are fed in antiphase directly by the feed network 43. To form a dual polarised array antenna the linear arrays of FIGS. 3 & 4 are combined in a sandwich structure between upper and lower apertured metal plates similar to the plates 10 & 14 of FIG. 1.

We have discovered that where vertically and horizontally polarised elements of this type are co-located or placed in close proximity to form a dual polarised element there is significant and useful interaction between the vertical and horizontal components of each element and that controlled variation of the feed layout of the vertical probes can be used to affect the performance of the horizontal component. For vertical polarisation, the balanced probe pairs are virtually unaffected by the presence of the horizontally probes, due to symmetry. However for horizontal polarisation parasitic coupling with the vertical probes and their termination condition affects significantly the azimuth radiation pattern beamwidth. The feed network layout determines the effective condition.

I claim:

1. A dual polarised flat plate antenna arrangement comprising a pair of apertures each aperture having a first pair of colinear probes extending into the aperture, the first pair of probes having a first orientation parallel to an axis about which the apertures are disposed, a second pair of colinear probes extending into the aperture, the second pair of probes having a second orientation orthogonal to that of the first pair of probes, first feed network means arranged to feed signals to the first pair of probes and a second feed network means arranged to feed signals to the second pair of probes, wherein in each aperture the respective probes for each orientation are fed as two pairs and each pair is fed in a balanced antiphase manner, characterised in that for the two pairs in at least one orientation the respective feed network means is arranged to introduce an unbalance between the balanced pairs.

2. An antenna arrangement according to claim 1 wherein the respective feed network means is arranged to introduce a phase unbalance between the balanced pairs.

3. An antenna arrangement according to claim 1 wherein the respective feed network means is arranged to introduce an amplitude unbalance between the balanced pairs.

4. An antenna arrangement according to claim 2 wherein each probe has a termination opposite a connection of the probe with the feed network and phase unbalance between a pair of probes is effected by alteration of at least one of the probe terminations of said pair of probes.

5. An array antenna comprised of a plurality of antenna arrangements as claimed in claim 1.

6. A method of controlling the radiation pattern of a dual polarised array antenna arrangement comprising a pair of apertures each aperture having a first pair of colinear probes extending into the aperture, the first pair of probes having a first orientation parallel to an axis about which the apertures are disposed, a second pair of colinear probes extending into the aperture, the second pair of probes having a second orientation orthogonal to that of the first pair of probes, first feed network means arranged to feed signals to the first pair of probes and a second fed network means arranged to feed signals to the second pair of probes, wherein in each aperture the respective probes for each orientation are fed as two pairs and each pair is fed in a balanced anti-phase manner, wherein for the two pairs in at least one orientation the respective feed network means is arranged to introduce an unbalance between the balanced pairs, the array antenna arrangement therefore having colocated radiation elements associated with respective polarisations, the method comprising the step of introducing into a feed network for one of the respective polarisations a deliberate unbalance of signal phase and/or amplitude with respect to the feed network for the other polarisation whereby interactive coupling between the colocated elements results in an alteration of the radiation pattern beamwidth for the other polarisation.

* * * * *